US007934978B2

(12) United States Patent
Wilson et al.

(10) Patent No.: US 7,934,978 B2
(45) Date of Patent: May 3, 2011

(54) ICE SKATE BLADE SHARPENING MACHINE

(75) Inventors: Murray David Wilson, Harrow (CA); Omer Leon Hageniers, Windsor (CA)

(73) Assignee: 1339513 Ontario Ltd., Harrow, Ontario (CA)

( * ) Notice: Subject to any disclaimer, the term of this patent is extended or adjusted under 35 U.S.C. 154(b) by 450 days.

(21) Appl. No.: 12/114,191

(22) Filed: May 2, 2008

(65) Prior Publication Data

US 2008/0280548 A1 Nov. 13, 2008

Related U.S. Application Data

(60) Provisional application No. 60/928,322, filed on May 10, 2007.

(51) Int. Cl.
*B24B 1/00* (2006.01)
*B24B 53/06* (2006.01)

(52) U.S. Cl. ..... 451/56; 76/83; 451/45; 451/72; 451/293

(58) Field of Classification Search ..... 451/21, 451/45, 56, 72, 178, 231, 278, 293, 443; 76/83

See application file for complete search history.

(56) References Cited

U.S. PATENT DOCUMENTS

| | | | | |
|---|---|---|---|---|
| 60,431 | A | | 12/1866 | Scott et al. |
| 83,339 | A | | 10/1868 | Thurston |
| 750,696 | A | | 1/1904 | Price |
| 1,100,976 | A | | 6/1914 | Hille |
| 1,181,831 | A | | 5/1916 | Browne |
| 1,786,553 | A | | 12/1930 | Thorngren |
| 2,055,665 | A | | 9/1936 | Moon |
| 2,181,923 | A | | 12/1939 | Smolarek |
| 2,229,374 | A | | 1/1941 | Devau |
| 2,486,850 | A | | 11/1949 | Ives |
| 2,904,342 | A | | 9/1959 | Jones et al. |
| 3,271,906 | A | | 9/1966 | Esopi |
| 3,517,659 | A | * | 6/1970 | Kane et al. ..... 125/11.03 |
| 3,735,533 | A | | 5/1973 | Salberg |
| 3,827,185 | A | * | 8/1974 | Smith ..... 451/72 |
| 4,055,026 | A | | 10/1977 | Zwicker |
| 4,094,101 | A | | 6/1978 | Robinson |
| 4,114,913 | A | | 9/1978 | Newell et al. |
| 4,271,635 | A | * | 6/1981 | Szalay ..... 451/72 |
| 4,294,043 | A | | 10/1981 | Sakcriska |
| D264,984 | S | | 6/1982 | Olivieri |

(Continued)

FOREIGN PATENT DOCUMENTS

CA 1179696 A1 12/1984

(Continued)

*Primary Examiner* — Timothy V Eley
(74) *Attorney, Agent, or Firm* — Harness, Dickey & Pierce, P.L.C.

(57) ABSTRACT

A ice skate blade sharpening machine comprises a skate holder which holds the blade in a releasably fixed position, a rotatable grinding wheel having a periphery and rotatable about a grinding wheel axis, and a contouring tool having a contour surface, moveable between an engaged position and a disengaged position, wherein in the engaged position the contouring tool is held in place with respect to the grinding wheel axis, the contour surface engages the rotating grinding wheel and grinds the periphery of the grinding wheel to define a grinding wheel contour, and wherein the grinding wheel contour grinds the blade to define a profile when the grinding wheel is rotating and the blade is held in the releasably fixed position.

33 Claims, 7 Drawing Sheets

U.S. PATENT DOCUMENTS

| | | | | | |
|---|---|---|---|---|---|
| 4,392,658 | A | | 7/1983 | Redmond et al. | |
| 4,411,250 | A | | 10/1983 | Lach | |
| 4,534,134 | A | * | 8/1985 | Consay et al. | 451/226 |
| 4,535,571 | A | | 8/1985 | Smith | |
| 4,615,144 | A | * | 10/1986 | Peacock et al. | 451/72 |
| 4,756,125 | A | | 7/1988 | Kadnar | |
| 4,805,586 | A | | 2/1989 | Borse | |
| 4,907,813 | A | | 3/1990 | Hall | |
| 5,009,039 | A | * | 4/1991 | Lager et al. | 451/11 |
| 5,287,657 | A | | 2/1994 | Tschida et al. | |
| 5,354,078 | A | | 10/1994 | Bellelsle | |
| 5,431,597 | A | | 7/1995 | Anderson | |
| 5,445,050 | A | | 8/1995 | Owens | |
| 5,499,556 | A | | 3/1996 | Exner et al. | |
| 5,547,416 | A | | 8/1996 | Timms | |
| D373,399 | S | | 9/1996 | Both | |
| 5,570,893 | A | | 11/1996 | Swande | |
| 5,591,069 | A | | 1/1997 | Wurthman | |
| 5,704,829 | A | | 1/1998 | Long | |
| 5,725,419 | A | | 3/1998 | Osthoff et al. | |
| 5,826,890 | A | | 10/1998 | Swande | |
| 6,030,283 | A | | 2/2000 | Anderson | |
| 6,116,989 | A | * | 9/2000 | Balastik | 451/72 |
| 6,203,028 | B1 | | 3/2001 | Kress | |
| 6,286,498 | B1 | | 9/2001 | Sung | |
| 6,308,700 | B1 | | 10/2001 | Lierse | |
| 6,368,198 | B1 | | 4/2002 | Sung et al. | |
| 6,422,934 | B1 | | 7/2002 | Blach et al. | |
| 6,443,819 | B2 | | 9/2002 | Sakcriska | |
| 6,467,778 | B1 | | 10/2002 | Goldsmith et al. | |
| 6,481,113 | B1 | | 11/2002 | Brenner | |
| 6,619,674 | B2 | | 9/2003 | Baldwin | |
| 6,695,322 | B2 | | 2/2004 | Goldsmith et al. | |
| D500,112 | S | | 12/2004 | Brumpton | |
| 6,830,251 | B2 | | 12/2004 | Titzmann | |
| 6,953,390 | B2 | | 10/2005 | Sakurai et al. | |
| D514,643 | S | | 2/2006 | Henderson | |
| 7,073,810 | B2 | | 7/2006 | Wilson | |
| 7,234,709 | B2 | | 6/2007 | Lambert | |
| 7,387,302 | B2 | | 6/2008 | Goldsmith et al. | |
| 7,648,146 | B2 | | 1/2010 | Tatomir | |
| 2002/0014041 | A1 | | 2/2002 | Baldoni et al. | |
| 2003/0106270 | A1 | | 6/2003 | Baldoni et al. | |
| 2005/0276979 | A1 | | 12/2005 | Slutz et al. | |
| 2007/0001426 | A1 | | 1/2007 | Wade | |

FOREIGN PATENT DOCUMENTS

| | | | |
|---|---|---|---|
| CA | 2173001 | A1 | 2/1997 |
| CA | 2 373 449 | A1 | 11/2000 |

* cited by examiner

ICE SKATE BLADE SHARPENING MACHINE

RELATED APPLICATION

This application claims priority benefit of U.S. Provisional Patent Application 60/928,322, filed on May 10, 2007.

FIELD OF THE INVENTION

This invention relates to improvements in ice skate blade sharpening machines, and more particularly, to ice skate blade sharpening machines which can create a wide variety of profiles on ice skate blades.

BACKGROUND OF THE INVENTION

In winter sports such as ice skating and hockey the blades of an ice skate are the point of contact for all of the forces generated in turns, spins, jumps, etc. Ice skates typically have a convex shape along a length of the skate blade and a concave shape across the width of the blade, defining two edges along the length of the blade. A skater can use either of these two edges in executing maneuvers on the ice surface. In order to maintain a desired blade configuration, a skate sharpening machine must be configured to create a groove along the length of the blade such that the two edges are of equal height.

As skate blades differ from one pair to another, the sharpening of the skate blade to a required profile has long been considered to be part art and part science. The operator of a skate sharpening machine is required to first dress a grinding wheel to have the desired contour and then ensure that during the grinding process the centerline of the contour on a wheel coincides with the centerline of the blade along its full length. If this is not done an irregular groove will be created along the length of the blade, with one edge being higher/lower than the other.

The dressing of the skate sharpening grinding wheel is traditionally carried out using a single point diamond dresser that is pivoted about an axis generally perpendicular to an axis of rotation of the grinding wheel. The single point diamond dresser is slowly swung through an arc that intersects the outer periphery of the grinding wheel, removing material from the wheel to create and define a grinding wheel contour. Since the dresser pivots, the contour formed on the grinding wheel is a convex arcuate surface with a radius typically in the range of ⅜ inch to 15/8 inch. Generally speaking several passes are required to achieve a surface with the desired quality. Once the grinding wheel contour has been created, it may be used to create a complementary concave surface on the skate blade.

It would be desirable to provide an ice skate blade sharpening machine that uses a contouring tool which can create one of many different shaped contours on the grinding wheel, such that a desired contour may be ground into the skate blade during the sharpening process.

SUMMARY OF THE INVENTION

In accordance with a first aspect, an ice skate sharpening machine comprises a skate holder which holds the blade in a releasably fixed position, a rotatable grinding wheel having a periphery and rotatable about a grinding wheel axis, and a contouring tool having a contour surface, moveable between an engaged position and a disengaged position, wherein in the engaged position the contouring tool is held in place with respect to the grinding wheel axis, the contour surface engages the rotating grinding wheel and grinds the periphery of the grinding wheel to define a grinding wheel contour, and wherein the grinding wheel contour grinds the blade to define a profile when the grinding wheel is rotating and the blade is held in the releasably fixed position.

From the foregoing disclosure and the following more detailed description of various preferred embodiments it will be apparent to those skilled in the art that the present invention provides a significant advance in the technology of ice skate sharpening machines. Particularly significant in this regard is the potential the invention affords for providing a high quality, low cost ice skate blade sharpening machine capable of generating a wide range of profiles on an ice skate blade. Additional features and advantages of various preferred embodiments will be better understood in view of the detailed description provided below.

Figure 1:
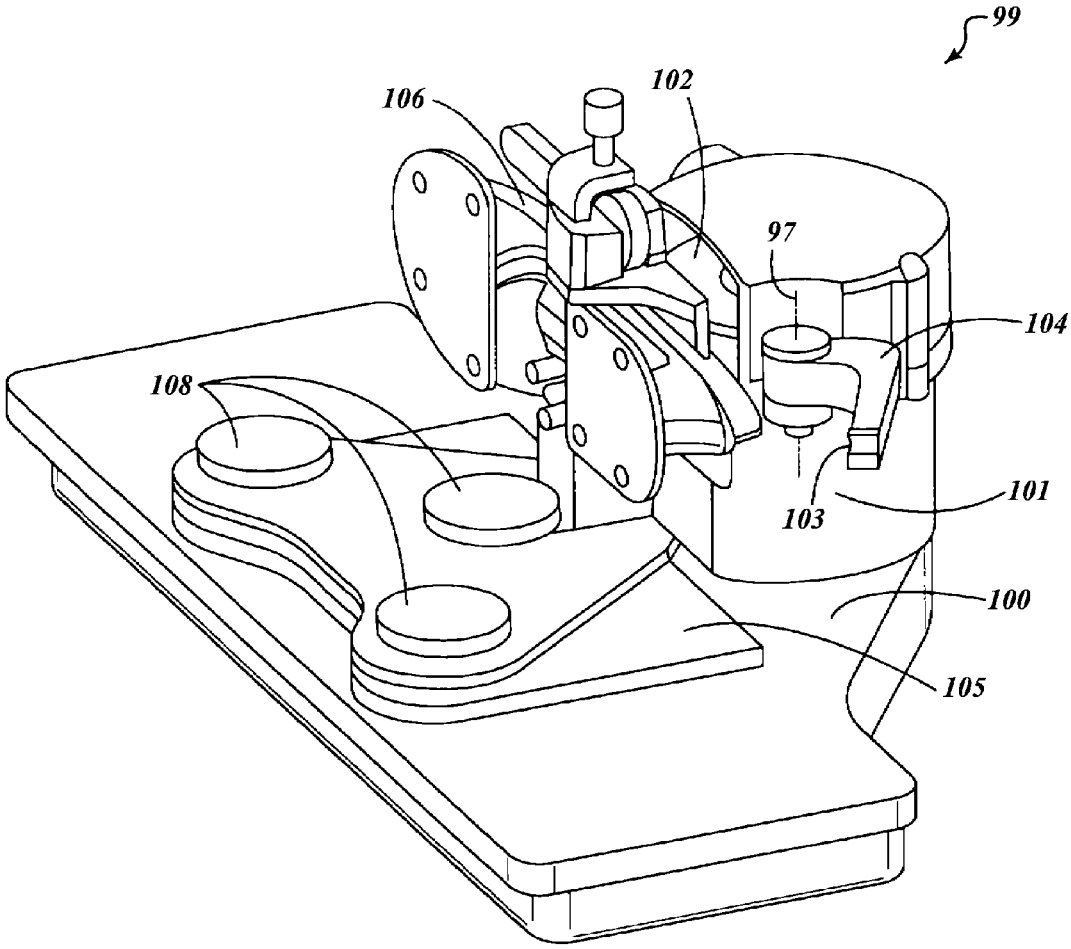
FIG. 1 is an isometric view of an ice skate blade sharpening machine in accordance with a preferred embodiment.

It should be understood that the appended drawings are not necessarily to scale, presenting a somewhat simplified representation of various preferred features illustrative of the basic principles of the invention. The specific design features of the ice skate blade sharpening machine as disclosed here, including, for example, the specific dimensions of the contouring tool, will be determined in part by the particular intended application and use environment. Certain features of the illustrated embodiments have been enlarged or distorted relative to others to enhance visualization and clear understanding. In particular, thin features may be thickened, for example, for clarity of illustration. All references to direction and position, unless otherwise indicated, refer to the orientation illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved ice skate blade sharpening machine disclosed here. The following detailed discussion of various alternative and preferred features and embodiments will illustrate the general principles of the invention with reference to an ice skate blade sharpening machine particularly suitable for ice skates used for playing winter sports such as hockey and figure skating. Other embodiments suitable for other applications will be readily apparent to those skilled in the art given the benefit of this disclosure.

Turning now to the drawings, FIG. 1 shows an ice skate blade sharpening machine 99 in accordance with a preferred embodiment. The blade sharpening machine 99 comprises a working surface 100, a motor in a vertical housing 101, a grinding wheel 102 rotated by the motor, a contouring tool 103, a pivot arm mechanism 104, and a skate holder 105. Also shown is a skate blade 106 to be sharpened.

Figure 2:
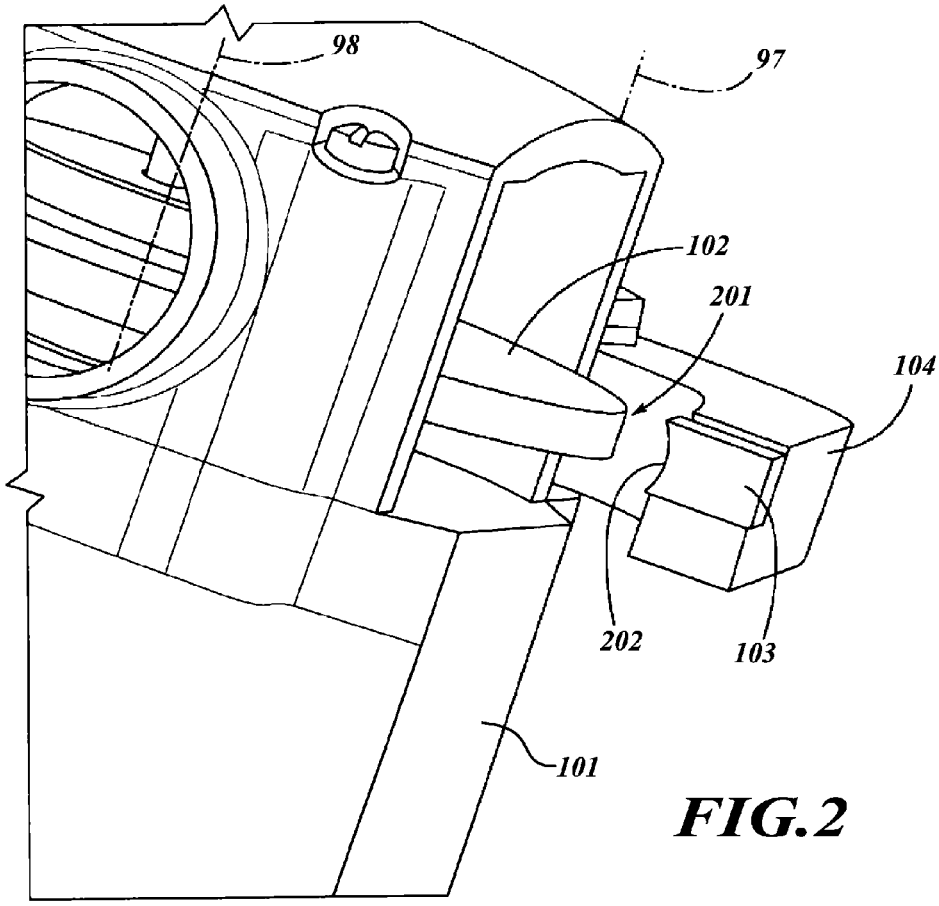
FIG. 2 is an isolated isometric view of a fixed contouring tool in close proximity to a grinding wheel during a dressing operation.

FIG. 2 shows the grinding wheel 102 having a periphery 201 which is as of yet unground into a desired profile. Forming such a profile is a two step process. First the contouring tool 103 dresses and shapes the grinding wheel 102 to define a grinding wheel contour 303 (shown in FIG. 3) by use of grinding the periphery 201 of the grinding wheel 102 against a contour surface 202. Typically this occurs by rotating the grinding wheel about a grinding wheel axis 98 while the contour surface 202 engages the grinding wheel 102. Second, rotation of the grinding wheel 102 about the axis 98 allows the grinding wheel contour 303 to engage and grind the ice skate blade 106 to form an ice skate blade profile 107. The ice skate blade profile 107 is typically the same shape as the contour surface 202, and opposite or a mirror image of the grinding wheel contour 303. Thus, if the contour surface is convex, the grinding wheel contour 303 is concave and the blade profile 107 is convex.

In sharpening the blade 100 of a skate it is important that a centerline 116 of the skate blade 106 be aligned with a centerline 112 of the contour 303 of the grinding wheel 102 as the blade 100 is moved by movement of the skate holder 105 during the blade sharpening process. See FIG. 3. Adjustment and proper alignment of the skate blade 106 with respect to the grinding wheel 102 is accomplished in part by three adjusting screws 108 located on the skate blade holder 105 (shown in FIG. 1).

The contouring tool 103 is mounted on an adjustment device, here the pivot arm 104 which is movable about a pivot arm axis 97 between an engaged position where the contour surface 202 engages the grinding wheel 102 and a disengaged position where the contour surface 202 does not engage the grinding wheel 102. As shown here, the pivot arm axis 97 is generally parallel to the grinding wheel axis 98. The pivot arm 104 allows for easy removal of one contouring tool 102 and replacement with another. Other adjustment devices for moving the contour surface 202 into and out of engagement with the grinding wheel 102 are discussed below.

Figure 3:
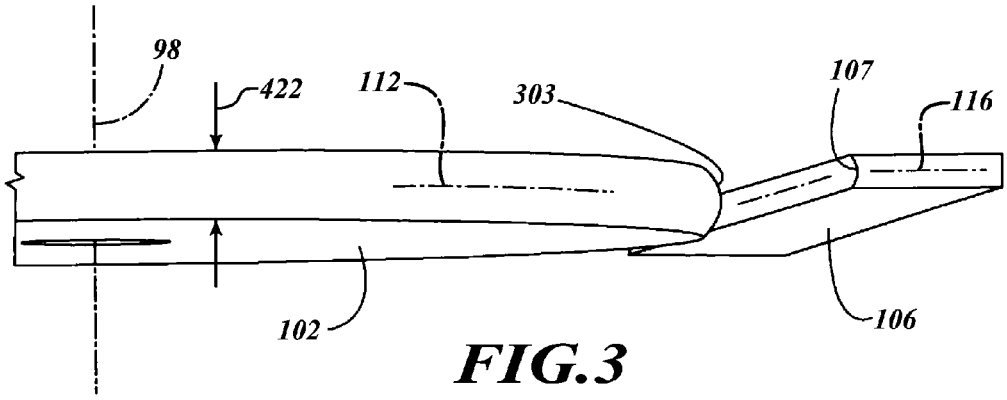
FIG. 3 is a side view of a skate blade in close proximity to the grinding wheel during the skate sharpening process.
Figure 4:
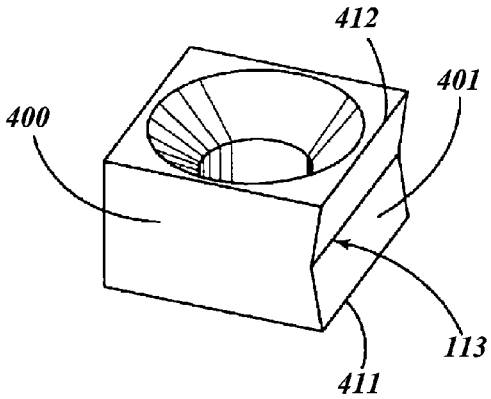
FIGS. 4-7 shows several preferred styles of fixed contouring tools for use in dressing grinding wheels.
Figure 5:
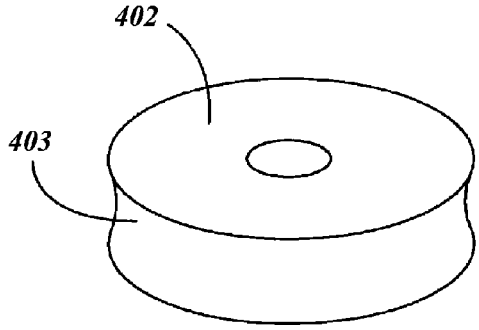
Figure 6:
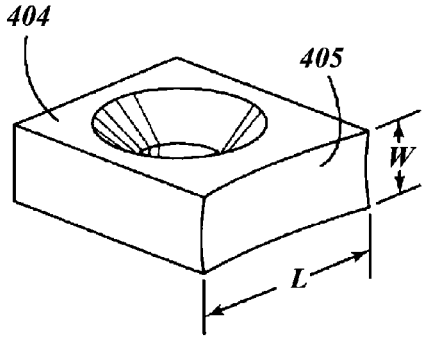
Figure 7:
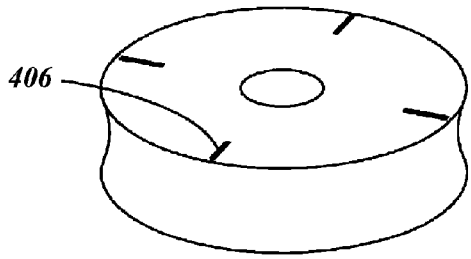

In accordance with a highly advantageous feature, the contour surface described herein may have any of a variety of cross sections instead of being limited to the convex arcuate profile of known blade sharpening devices. This makes it possible for skaters to experiment and find a given profile that gives them better performance in skating than currently used profiles. FIG. 4-FIG. 7 show several examples of contouring tools, each with a different contour surface. In FIG. 4, a bar style contouring tool 400 has a contouring surface 401 formed as a pair of generally linear surfaces. In FIG. 5 and FIG. 7, alternatively a disc style contouring tool may be used. Disc style contouring tools can be advantageous in that they can be turned, thereby exposing a fresh surface area of the disc to the grinding wheel 102 and providing for a longer life of the tool. In FIG. 5, a disc style contouring tool 402 is provided with a concave contour surface, or, as in contour surface 403 the shape of contour surface may be constantly changing. For example, the convex arcuate cross section may be a variable radius such as, for example, from ⅜" to 1" extending continuously around the disc. In FIG. 6, a bar style contouring tool 404 may be formed with a double concave contour surface 405, with curved surfaces along both the width W and length L of the contour surface. Each of these surfaces may be thought of as concave in the broad sense that the edges (such as edges 411 and 412 in FIG. 4) cut deeper into the grinding wheel 102 than does the middle (such as middle 413 in FIG. 4) of the contour surface 401. In FIG. 6, the second radius on the double concave contour surface 405 can provide better conformity between the fixed contouring tool 404 and the grinding wheel 102 and can provide longer fixed contouring tool life because of a larger contact area. Preferably the width W of the contour surface is at least equal to the width 422 (FIG. 3) of the grinding wheel contour 303, allowing for complete contact of the grinding wheel contour 303 without moving the contour tool with respect to the grinding wheel axis 98 of rotation.

The contouring tool 103 may advantageously be manufactured to various dimensions and geometries to cover a spectrum of profiles normally used by skate sharpeners. For example, when the desired profile 107 on the blade 106 is concave and has a radii, the profile dimensions may be of: ¼, ⅜, ½, ⅝, ¾, ⅞, 1, 11/8, 11/4, 13/8, 11/2, and 15/8 (inches). Other combinations of contouring tool shapes and contour surfaces, such as parabolic and elliptical shapes, or non-concave shapes such as flat bottomed or multi-groove, will be readily apparent to those skilled in the art given the benefit of this disclosure.

Figure 8:
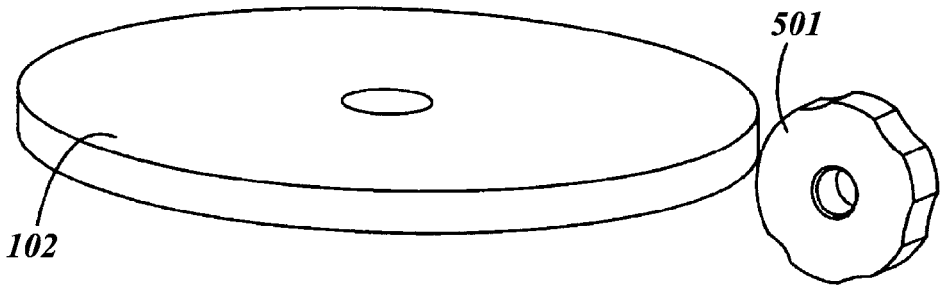
FIG. 8 shows an indexable disc fixed contouring tool in close proximity to the grinding wheel.

Advantageously, the contouring tools disclosed here can be readily interchangeable and allow for rapid switching from one radius to another as sharpening goes from one set of skates to another. Changing a contouring tool can be done much quicker than the time required to redress a grinding wheel to a different radius using the traditional single point diamond dresser. In accordance with another highly advantageous feature, a contouring tool 501 may be indexable as shown in the preferred embodiment of FIG. 8. The contouring tool 501 comprises an indexable disc that has several different contours around its edge. Marks or indicators 406 (FIG. 7) may be provided to indicate to a user what contour surface options are available. Preferably while disengaged from the grinding wheel 102, the contouring tool 501 can be rotated or indexed to one of several different positions, with each position having a separate contour surface. As shown, the contouring tool is perpendicular to the grinding wheel axis 98 (FIG. 3). Preferably the contouring tool 501 would be held in position with respect to the grinding wheel axis 98 while in the engaged position.

Contouring tools 103 disclosed here are preferably coated with an abrasive material that is harder than material which forms the grinding wheel 102. In turn, the grinding wheel material is preferably harder than the material that forms the ice skate blades 106. A preferred abrasive coating suitable for use on the contouring tool here is diamond dust, chips or grit in a plated metallic surface coating such as electroplated nickel.

Figure 9:
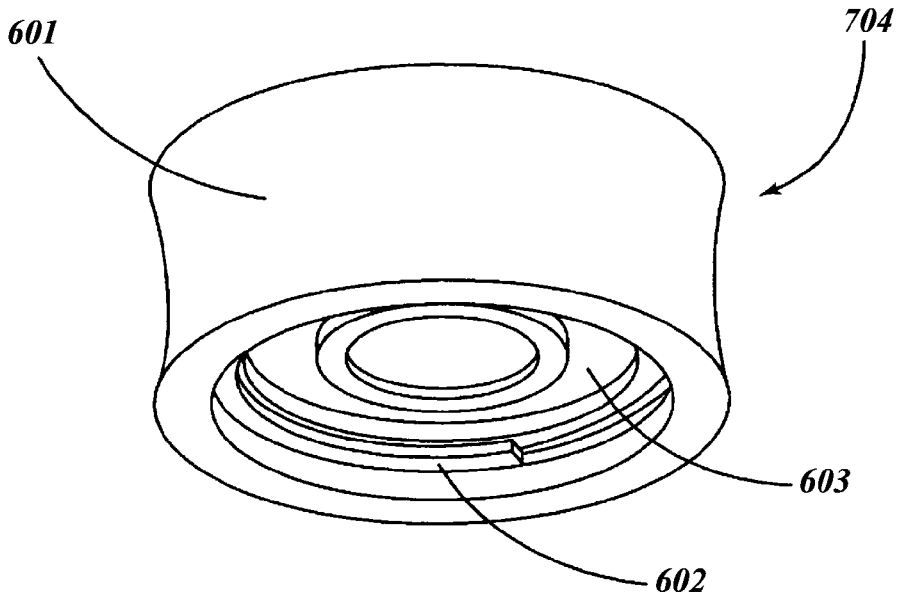
FIG. 9 shows a preferred embodiment of the rotating contouring tool showing the contour and the ball bearing assembly.
Figure 10:
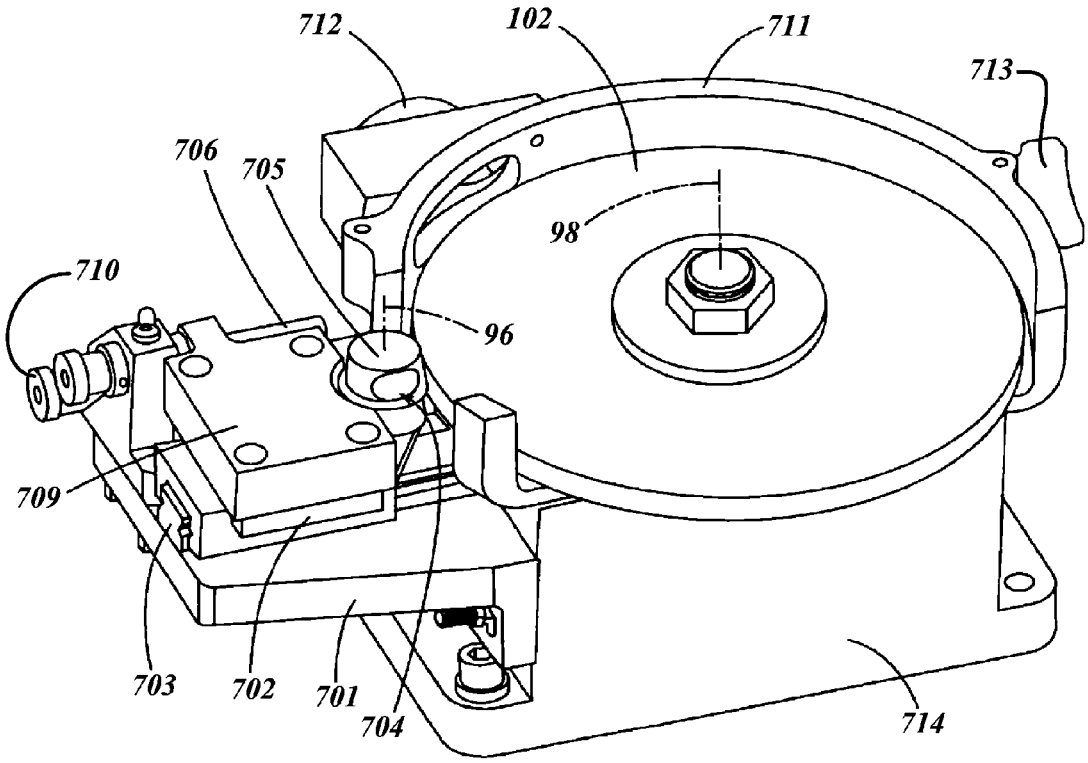
FIG. 10 is an isometric view showing a rotating contouring tool mounted on a skate blade sharpening machine. The rotating contouring tool is mounted on a spindle in such a manner as to allow easy interchange of rotating contouring tools.

FIG. 9 shows another preferred embodiment of a rotating contouring tool, sometimes referred to as a crush roll contouring tool 704. The contouring tool 704 has a contour surface 601, a bearing assembly 603 and retaining ring 602. FIG. 10 shows the crush roll contouring tool 704 rotatably mounted about axis 96 on a skate sharpening machine. The tool 704 is mounted on a vertical spindle that is attached to a metal plate, 709. This metal plate 709 is attached to a linear ball slide table 702 which rides on a ball slide rail 703, allowing the contouring tool 704 to be adjusted towards and away from the axis of rotation 98 of the grinding wheel 102.

The ball slide rail 703 is firmly affixed to a bracket 701 that provides a rigid link to a skate sharpening machine spindle housing 714. This rigid link is used to absorb the force generated when the crush roll contouring tool 704 is forced into the engagement position, i.e., into contact with the grinding wheel 102 through the action of the lead screw 706 on the heavy metal plate 709. The rotation of the lead screw 706 is accomplished by turning the adjusting knob 713, which is linked to the lead screw 706 through a timing belt drive system. Also shown in FIG. 7 is a guard 711 and a dust collection port 712. Easy interchange of the crush roll contouring tool 704 is helped by the use of ball plunger 801 located in the retainer 705. The retainer 705 provides for positive vertical location of the crush roll contouring tool 704 with respect to the heavy metal plate 709 during operation. The heavy metal plate 709 is designed to be sufficiently massive so that it can resist vibrational loading of the grinding wheel 102 and the crush roll contouring tool 704. When in the engaged position, the contouring tool 704 rotates against the grinding wheel 102 about its axis 96 and is held in place with respect to the grinding wheel axis 98.

Figure 11:
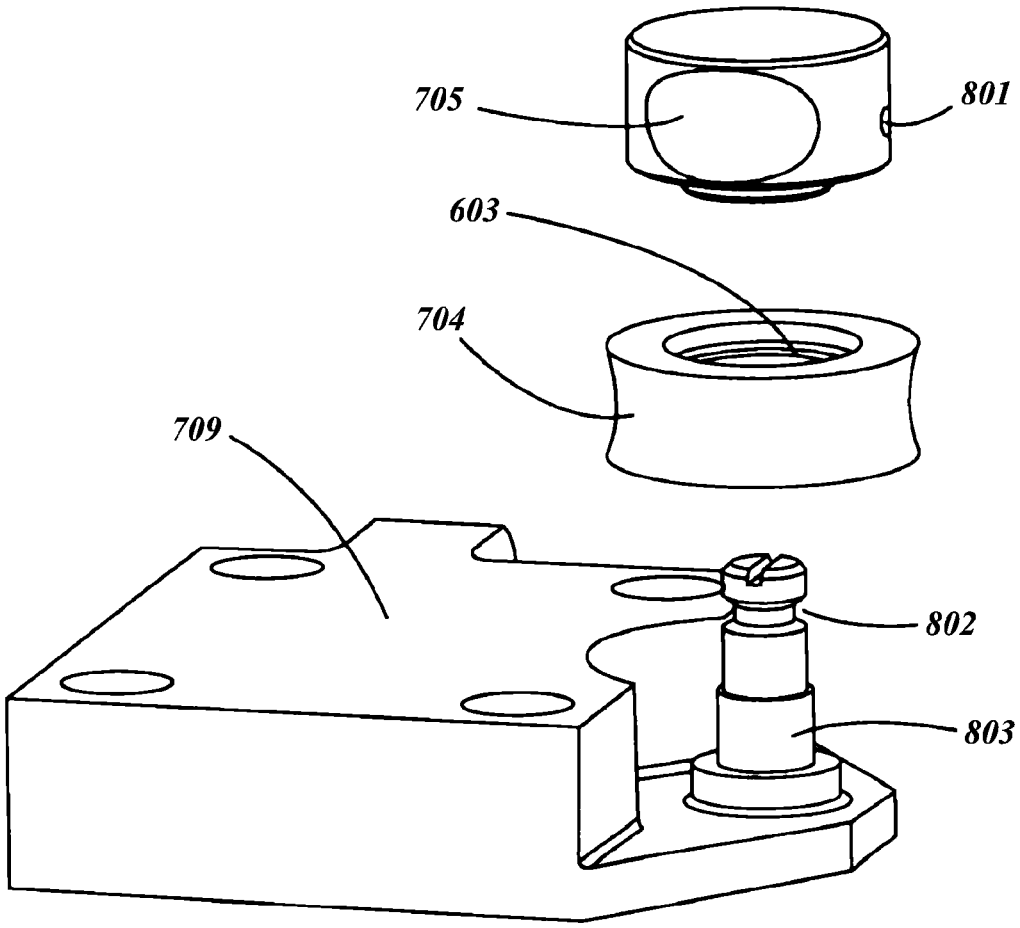
FIG. 11 is an exploded isometric view the mounting of the rotating contouring tool on the spindle.

FIG. 11 shows an exploded view of the retainer 705, spindle 803, contouring tool 704 and heavy metal plate 709. The retainer 705 is typically held in place by a ball plunger 801 that locates in a groove 802 in the spindle 803. Once the retainer 705 is lifted off the spindle 803 the crush roll contouring tool 704 can be easily removed and replaced with a different tool.

Figure 12:
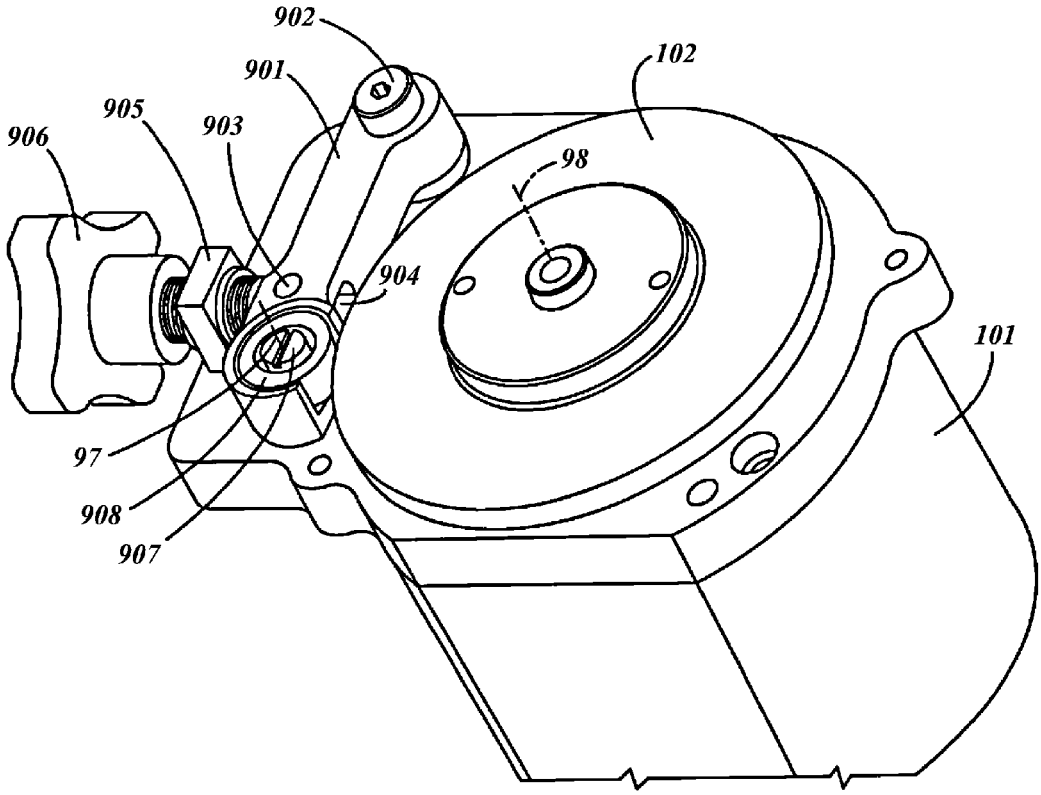
FIG. 12 is an isometric view showing the rotating contouring tool mounted on the pivoting arm so that it can be forced into the grinding wheel.

FIG. 12 shows an alternative preferred embodiment of an ice skate blade sharpening machine. This embodiment is advantageous in terms of its compactness and is therefore desirable for use in portable or smaller ice skate blade sharpening machines. A crush roll contouring tool 908 is mounted on a screw that serves as a spindle 907 and is screwed onto a pivot arm 901. This pivot arm 901 is anchored to a mounting plate that also is attached to the motor housing 101 via a shoulder screw 902. Since the shoulder screw 902 is oriented with its axis parallel to the axis of the grinding wheel 102, the movement of the crush roll contouring tool 908 is in the same plane as the plane of the grinding wheel 102. Movement of the pivot arm 901 is accomplished by turning knob 906 which turns lead screw 904 in the threaded barrel pin 903, pushing the pivot arm 901 forward. The force required to push the pivot arm 901 forward is absorbed by the pivot block 905. This allows for the rotation created by the movement of the pivot arm 901. Preferably the pivot arm 901 is heavy, as its inertia helps damp out vibrations between the grinding wheel 102 and the crush roll contouring tool 908.

It will be understood here by those skilled in the art that the contouring tool is held in place with respect to the grinding wheel axis in the sense although there may be some vibrational movement as the contouring tool engages the grinding wheel periphery, the contouring tool is staying in the same plane with respect to the grinding wheel axis while in the engaged position. In the preferred embodiments shown in the drawings, contouring tool 103 in FIG. 2 is held in place on the pivot arm; in FIG. 8, although the indexable contouring tool 501 is adjustable, it is held in place while in the engaged position; and in FIG. 10, although the contouring tool 704 is rotatable about its axis 96 while in the engaged position, it is held in place with respect to the grinding wheel axis 98.

The embodiments discussed were chosen and described to provide the best illustration of the principles of the invention and its practical application to thereby enable one of ordinary skill in the art to use the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A sharpening machine for a blade of an ice skate, the sharpening machine comprising:

a housing having a motor;

a grinding wheel having a periphery, said grinding wheel is connected to said motor and is rotatable about a grinding wheel axis;

an adjustment device connected to said housing, said adjustment device having a fixed spindle that defines an axis movable relative to said grinding wheel axis; and a contouring tool having a contour surface, said contouring tool is rotatably connected to said fixed spindle and is movable on said adjustment device between an engaged position and a disengaged position, when said contouring tool is in said engaged position and said grinding wheel is rotating said contour surface contacts said grinding wheel to rotate said contouring tool and grind said periphery of said grinding wheel with said contour surface to define a grinding wheel contour, said grinding wheel contour is operable to produce a blade profile on the blade of the ice skate, said adjustment device restricts movement of said contouring tool to maintain said axis of said fixed spindle parallel to said grinding wheel axis but permits a distance between said axis of said fixed spindle and said grinding wheel axis to change when moving said contouring tool between said engaged position and said disengaged position, said adjustment device includes a slide table connected to said contouring tool, said slide table is movable relative to said housing to engage said contouring tool with said periphery of said grinding wheel in said engaged position.

2. The sharpening machine of claim 1, wherein said slide table includes a lead screw that moves said slide table between said engaged position and said disengaged position.

3. The sharpening machine of claim 1, wherein said contour surface of said contouring tool includes an electroplated coating having diamond chips.

4. The sharpening machine of claim 1, wherein said contouring tool is configured to remain rotationless until contact with said periphery of said grinding wheel when said grinding wheel is rotating.

5. The sharpening machine of claim 1, wherein said contouring tool is not rotated by a motor other than the motor connected to the grinding wheel.

6. A sharpening machine that sharpens a blade of an ice skate with a periphery of a grinding wheel rotated by a motor about a grinding wheel axis, the sharpening machine comprising:

a housing;

an adjustment device connected to said housing; and a contouring tool having an axis, a contour surface, and a bearing assembly, said contouring tool is rotatably connected to said adjustment device with said bearing assembly and is movable with said adjustment device between an engaged position and a disengaged position, said contour surface is operable to contact the grinding wheel rotated by the motor to rotate said contouring tool and to dress the periphery of the grinding wheel with said contour surface to define a grinding wheel contour, said grinding wheel contour is operable to produce a blade profile on the blade of the ice skate, wherein said adjustment device restricts movement of said contouring tool to maintain said axis of said contouring tool parallel to the grinding wheel axis but permits a distance between said axis of said contouring tool and the grinding wheel axis to change when moving said contouring tool between said engaged position and said disengaged position, said adjustment device includes a slide table connected to said contouring tool, said slide table is moveable relative to said housing to engage said contouring tool with the periphery of the grinding wheel in said engaged position.

7. The sharpening machine of claim 6, wherein said contour surface of said contouring tool includes an electroplated coating having diamond chips.

8. The sharpening machine of claim 6, wherein said contouring tool is configured to remain rotationless until contact with said periphery of the grinding wheel when the grinding wheel is rotating.

9. The sharpening machine of claim 6, wherein said contouring tool is not rotated by a motor other than the motor connected to the grinding wheel.

10. A method of dressing a grinding wheel to produce a grinding wheel contour that in turn cuts a blade profile on a blade of an ice skate, the method comprising:

rotating a periphery of the grinding wheel about a grinding wheel axis;

engaging a contouring tool having a contour surface with the periphery of the grinding wheel to form the grinding wheel contour, said contouring tool rotatable about an axis; and holding the axis of the contouring tool parallel to the grinding wheel axis while engaging the contour surface with the periphery of the grinding wheel, wherein the holding of the axis of the contouring tool parallel to the grinding wheel axis includes preventing movement of the contouring tool to maintain the axis of the contouring tool parallel to the grinding wheel axis but permitting a distance between the axis of the contouring tool and the grinding wheel axis to change when moving the contouring tool to and from a position that engages the contouring tool with the periphery of the grinding wheel, wherein the engaging of the contouring tool having the contour surface with the periphery of the grinding wheel includes moving a slide table on which the contouring tool rotates on a fixed spindle to and from the position that engages the contouring tool with the periphery of the grinding wheel.

11. The method of claim 10 further comprising only imparting rotation on the contouring tool by contact with the periphery of the grinding wheel when the grinding wheel is rotating.

12. The sharpening machine of claim 6, wherein said slide table includes a lead screw that is operable to move said slide table between said engaged position and said disengaged position.

13. The sharpening machine of claim 12, wherein said lead screw has an axis of rotation that is substantially perpendicular to said axis about which said contouring tool rotates.

14. The sharpening machine of claim 6, wherein said slide table includes a rail connected to said housing, said slide table is configured to translate between said engaged position and said disengaged position on said rail.

15. The sharpening machine of claim 14, wherein said slide table includes a lead screw that is operable to move said slide table between said engaged position and said disengaged position.

16. The sharpening machine of claim 6, wherein said contouring tool includes a retainer that releasably connects said contouring tool to said slide table.

17. The sharpening machine of claim 16, wherein said retainer has an outer circumference that is smaller than an outer circumference defined by said contour surface of said contouring tool.

18. The sharpening machine of claim 6, wherein said contour surface of said contouring tool has a parabolic shape.

19. The sharpening machine of claim 6, wherein said contour surface of said contouring tool has an elliptical shape.

20. The sharpening machine of claim 6, wherein said contour surface of said contouring tool has a flat-bottomed shape.

21. A sharpening machine including a grinding wheel having a perimeter that is rotatable about a first axis, the sharpening machine comprising:

an adjustment device adapted to be coupled to a structure of the sharpening machine, the adjustment device including a slide table movable along a predetermined feed axis;

a shaft mounted to the slide table, the shaft defining a second axis that is generally parallel to the first axis when the adjustment device is coupled to the structure; and a contouring tool coupled to the shaft and rotatable about the second axis, the contouring tool having a contour surface, wherein movement of the slide table along the feed axis is configured to translate the contouring tool into and out of engagement with the grinding wheel to facilitate dressing of the perimeter of the grinding wheel to a grinding wheel contour.

22. The sharpening machine of claim 21, wherein the contour surface of the contouring tool includes an electroplated coating having diamond chips.

23. The sharpening machine of claim 21, wherein the contouring tool is configured to remain rotationless until contact with the perimeter of the grinding wheel when the grinding wheel is rotating.

24. The sharpening machine of claim 21, wherein the contouring tool is not rotated by a motor other than a motor connected to the grinding wheel.

25. The sharpening machine of claim 21, wherein the slide table includes a lead screw that is operable to move the slide table between an engaged position and a disengaged position.

26. The sharpening machine of claim 25, wherein the lead screw has an axis of rotation that is substantially perpendicular to the axis about which the contouring tool rotates.

27. The sharpening machine of claim 21, wherein the slide table includes a rail on which the slide table is configured to translate between an engaged position and a disengaged position.

28. The sharpening machine of claim 27, wherein the slide table includes a lead screw that is operable to move the slide table between the engaged position and the disengaged position.

29. The sharpening machine of claim 21, wherein the contouring tool includes a retainer that releasably connects the contouring tool to the slide table.

30. The sharpening machine of claim 29, wherein the retainer has an outer circumference that is smaller than an outer circumference defined by the contour surface of the contouring tool.

31. The sharpening machine of claim 21, wherein the contour surface of the contouring tool has a parabolic shape.

32. The sharpening machine of claim 21, wherein the contour surface of the contouring tool has an elliptical shape.

33. The sharpening machine of claim 21, wherein the contour surface of the contouring tool has a flat-bottomed shape.

* * * * *